US006054243A

United States Patent [19]

Yamane et al.

[11] Patent Number: 6,054,243

[45] Date of Patent: Apr. 25, 2000

[54] CARRIER AND DEVELOPER MATERIAL, AND AN IMAGE FORMING METHOD

[75] Inventors: Kenji Yamane; Hiroyuki Kozuru, both of Hachioji, Japan

[73] Assignee: Konica Corporation, Japan

[21] Appl. No.: 09/179,130

[22] Filed: Oct. 26, 1998

[30] Foreign Application Priority Data

Oct. 29, 1997 [JP] Japan ..... 9-297077

[51] Int. Cl.[7] ..... G03G 13/16; G03G 9/107; G03G 9/113

[52] U.S. Cl. ..... 430/126; 430/106.6; 430/108; 430/111

[58] Field of Search ..... 430/106.6, 108, 430/111, 126

[56] References Cited

U.S. PATENT DOCUMENTS

| | | | |
|---|---|---|---|
| 5,795,693 | 8/1998 | Okado et al. | 430/106.6 |
| 5,798,198 | 8/1998 | Sukovich et al. | 430/106.6 |
| 5,885,742 | 3/1999 | Okado et al. | 430/108 |

FOREIGN PATENT DOCUMENTS

| | | | |
|---|---|---|---|
| 64-91144 | 4/1989 | Japan | 430/108 |
| 6118724 | 4/1994 | Japan . | |
| 728281 | 1/1995 | Japan . | |

OTHER PUBLICATIONS

Derwent Abstract 89–147806/20 of JP 64–91144 (Pub Apr. 1989) Attached to JP 64–91144.

Japio Abstract AN 89–091144 of JP 64–91144 (Pub Apr. 1989).

*Primary Examiner*—Janis L. Dote

*Attorney, Agent, or Firm*—Jordan B. Bierman; Bierman, Muserlian and Lucas

[57] ABSTRACT

A silicone resin-coated carrier for a developer of an electrostatic latent image is disclosed. The surface index S of the carrier is between 10.0 and 70.0.

$$S=(S_{BET}/X)/Sc$$

$S_{BET}$: BET specific surface area ($m^2/g$)

X: C value (carbon content in respect to the total carrier, weight percent)

Sc: surface area ($m^2/g$) when assumed to be a true sphere

A developer containing the carrier and a developing method employing the carrier are also disclosed.

13 Claims, 3 Drawing Sheets

CARRIER AND DEVELOPER MATERIAL, AND AN IMAGE FORMING METHOD

FIELD OF THE INVENTION

The present invention relates to a carrier and a developer material, using the same, for developing an electrostatic latent image, which are employed for copiers, printers, and the like, and an image forming method.

BACKGROUND OF THE INVENTION

Conventionally, as a developer material employed in electrophotographic systems, a two component developer material, consisting of a carrier and a toner, has been widely employed.

In recent years, as a result of improvements in carrier durability, image quality, and especially fine line reproducibility, a resin coated carrier (hereinunder referred to as coated carrier) is primarily employed. However, during repeated image formation, a coated resin is worn and peels off, and the magnetic particles employed as a core are exposed on the surface.

As a result, the charge applying capability of a carrier to a toner is markedly deteriorated, and Background Staining and toner in-machine scattering are caused. Furthermore, a so-called toner spent phenomenon is caused in which a part of the toner component adheres to the surface of the carrier. Specifically during continuous copying, because the toner and the carrier are subjected to large shearing force, the coated resin is readily worn and peels off, and in addition, the toner spent phenomenon is accelerated. Because the durability of a two component developer material, in most cases, depends mainly on the carrier, improvement in carrier durability becomes a major goal.

Silicone resin has received attention, as a highly durable coating resin. Because silicone resin exhibits a three dimensional structure, abrasion resistance is markedly improved. Furthermore because the silicone resin is a low surface energy resin, the toner spent phenomenon is hardly caused to result in high durability.

However, because the silicone resin-coated carrier generally exhibits low charge application capability, Japanese Patent Publication Open to Public Inspection No. 6-118724 proposes a coating resin hardened by incorporating a methylated melamine resin into the silicone resin, and Japanese Patent Publication Open to Public Inspection No. 7-28281 proposes a coating resin in which a siloxane compound having a specified structure is added into the silicone resin. However, because it is difficult to disperse these compounds uniformly into the silicone resin, a carrier resulting in uniform chargeability is not obtained.

Furthermore, Japanese Patent Publication Open to Public Inspection No. 64-91144 proposes a method in which a carrier is subjected to mechanical agitation to enhance the charge amount. However, in this method, until the desired charge amount is obtained, mechanical impact is continuously applied. Thus, as a result of the application of the excessive impact, the silicone coating resin of the carrier is damaged. When copying is repeatedly carried out employing the resulting carrier, the charge amount of the developer material decreases to result in the formation of background staining and an increase in toner scattering. Namely, the durability of a developer material is unexpectedly degraded and therefore, this method is not a practical means.

SUMMARY OF THE INVENTION

Objects of the invention are as follows:

(1) To provide a carrier which exhibits excellent charge application capability, and high durability for repeated copying, such as no formation of spent, layer peeling, and abrasion.

(2) To provide a two component developer material which maintains a high charge amount, and results in quality images with high density and minimum Background Density during repeated copying.

(3) To provide an image forming method which maintains a high charge amount and results in quality images with high density and minimum background stain during repeated copying.

(4) To provide a carrier which exhibits stable charge application capability from the commencement of copying, and high durability without causing spent formation, layer peeling and abrasion over the extended period of time.

(5) To provide a developer material which enables the formation of a stable charge amount from the beginning of copying, and as a result, results in quality images with high density and minimum Background Density over an extended period of time.

(6) To provide an image forming method which enables the formation of a stable charge amount from the commencement of copying, and as a result, results in quality images with high density and minimum background stain over an extended period of time.

The present invention and embodiments thereof are described below.

A carrier which is coated with a silicone resin and exhibits the surface index S of 10.0 to 70.0.

$$S=(S_{BET}/X)/Sc$$

$S_{BET}$: BET specific surface area ($m^2/g$) of the carrier

X: C value (carbon content of the silicone resin in weight percent based on the total resin coated carrier)

Sc: surface area ($m^2/g$) when assumed to be a true sphere

A developer material composed of at least a silicone resin-coated carrier and a toner, wherein the surface index S of the carrier is between 10.0 and 70.0.

$$S=(S_{BET}/X)/Sc$$

$S_{BET}$: BET specific surface area ($m^2/g$) of the carrier

X: C value (weight percent)

Sc: surface area ($m^2/g$) when assumed to be a true sphere

An image forming method wherein an electrostatic latent image on a photoreceptor is developed to a toner image employing a developer material composed of at least a toner and a silicone resin-coated carrier; the resulting toner image is transferred to a supplied image transfer material and thereafter, the residual toner on the photoreceptor is cleaned, the image-forming method in which the surface index S is between 10.0 and 70.0.

$$S=(S_{BET}/X)/Sc$$

S=: BET specific surface area ($m^2/g$) of the carrier

X: C value (weight percent)

Sc: surface area ($m^2/g$) when assumed to be a true sphere

A silicone resin-coated carrier, the surface index S of the carrier is to be between 10.0 and 70.0, and prior to mixing the toner and the carrier, the carrier which is subjected to mechanical impact.

$$S=(S_{BET}/X)/Sc$$

$S_{BET}$: BET specific surface area ($m^2/g$) of the carrier

X: C value (weight percent)

Sc: surface area ($m^2/g$) when assumed to be a true sphere

A two component developer material composed of at least a silicone resin-coated carrier and a toner, the developer material in that the toner is composed of at least a binder resin, a colorant, and a positively chargeable charge control agent; the surface index S of the carrier is to be between 10.0 and 70.0 and prior to mixing the toner and the carrier, the carrier is subjected to mechanical impact.

$$S=(S_{BET}/X)/Sc$$

$S_{BET}$: BET specific surface area ($m^2/g$) of the carrier

X: C value (weight percent)

Sc: surface area ($m^2/g$) when assumed to be a true sphere

An image forming method in which an electrostatic latent image on a photoreceptor is developed into a toner image employing a developer material composed of at least a toner and a silicone resin-coated carrier; the resulting toner image is transferred to a supplied image transfer material and thereafter, wherein the toner is composed of at least a binder resin, a colorant, and a positively chargeable charge control agent; the surface index S of the carrier is to be between 10.0 and 70.0; and prior to mixing the toner and the carrier, the carrier is subjected to mechanical impact.

$$S=(S_{BET}/X)/Sc$$

$S_{BET}$: BET specific surface area ($m^2/g$) of the carrier

X: C value (weight percent)

Sc: surface area ($m^2/g$) when assumed to be a true sphere

DETAILED DESCRIPTION OF THE INVENTION

Figure 1:
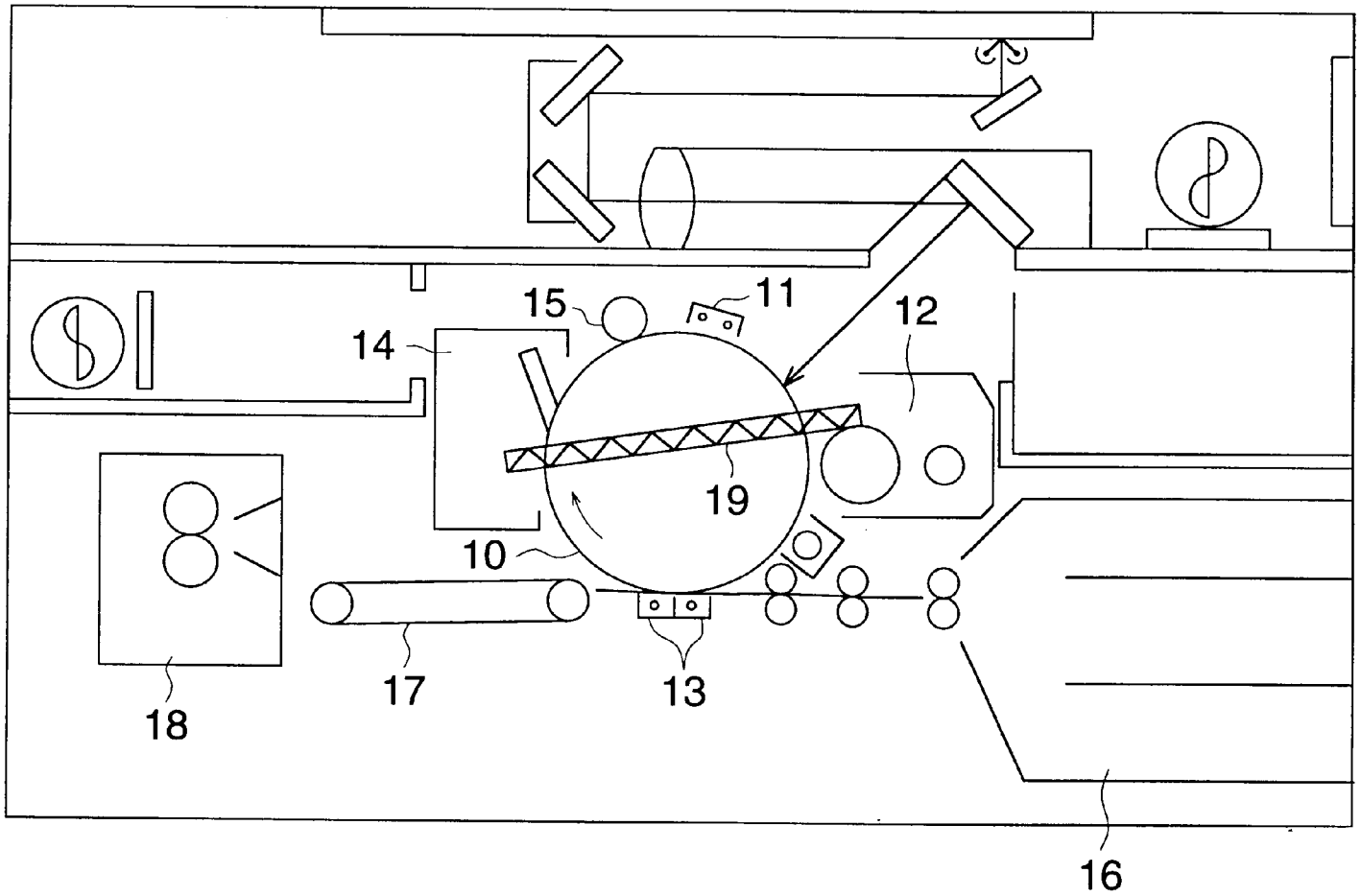
FIG. 1 is a schematic sectional view explaining the image forming method of the present invention.

The silicone resin-coated carrier is subjected to low charge application capability and, a sufficient charge amount required to work as the developer material cannot be obtained. This problem was solved by employing a silicone resin-coated carrier exhibiting a surface index of 10.0 to 70.0.

In the formula, Sc represents a theoretical surface area when a carrier is assumed to be a true sphere; $S_{BET}$ represents the BET specific surface area of a coated carrier; and the C value represents the carbon content in respect to the total carrier.

Though the mechanism is not clarified, the following estimation has been made. In order to control the surface index between 10.0 and 70.0, it is necessary to control the BET specific surface area ($S_{BET}$) of the coated carrier. The BET specific surface area cannot be unconditionally specified because it depends on the carrier diameter and the coated resin amount. However, it is preferably between about 0.4 and about 2.5 $m^2/g$ at a grain diameter of 60 $\mu$m. At the time, the theoretical surface area (herein no size distribution is considered), when a carrier is assumed to be a true sphere, is 0.2 $m^2/g$ according to $(4\pi r^2)/(4/3\pi r^3 d)$, wherein r represents a carrier radius, and d represents specific gravity of 4.5). Namely, the BET value of the resin coated-carrier is much larger than the theoretical value.

Referring to the results, when the carrier surface is microscopically observed, there is found very small unevenness which suggests the presence of a reticulate configuration. Due to this, the BET specific surface area is affected by the thickness direction of a coating resin. On account of this configuration, because triboelectrical chargeability with a toner is enhanced and the generated charge is readily maintained, it is estimated that charging capability is improved.

Accordingly, the carrier can be prepared which exhibits efficient charge application capability and high durability which minimizes the formation of spent, peeling and abrasion during repeated copying.

In order to obtain a desired resin coated carrier BET specific surface area value, a silicone resin is coated onto the surface of a carrier, and thereafter, when cured, the curing time and temperature are regulated.

It is known that when a silicone resin-coated carrier is subjected to mechanical stress in the interior of a processor, a charge amount is enhanced. Though the mechanism of this phenomenon is not clarified, like as the present invention, prior to mixing a carrier with toner, by applying mechanical impact, desired chargeability is quickly obtained. As a result, because it is unnecessary to apply the excessive stress to the carrier, the layer peeling of the carrier can be minimized.

As a result, from the commencement of copying, stable charge application capability is obtained and the high durable carrier is obtained which results in minimum formation of spent, layer peeling, and abrasion.

Because sufficient charge application capability is obtained; the decrease in layer strength, layer peeling, and abrasion are minimized; during repeated copying, no decrease in a charge amount is caused; and the formation of Background Density and toner scattering are minimized, the surface index of the carrier is preferably between 10.0 and 70.0 and more preferably between 15.0 and 60.0.

(Structure of Apparatus to Apply Impact to Carrier)

In order to apply impact to a carrier, are employed stirring mixers comprising a horizontal direction rotator, such as a nauta mixer, a tabular mixer, a V type mixer, a W cone type mixer, a Henschel mixer, etc.

(Measurement Method of BET Specific Surface Area)

The BET specific surface area was measured by a BET 1 point method (employed mixture gas $N_2$: He=30:70 (volume ratio)) employing a Micromeritix Flowsorb II 2300 Type (manufactured by Shimadzu Seisakusho).

(Calculation Method of Sc)

Sc is obtained employing a Laser Diffraction Type Grain Size Distribution Measurement Apparatus (HELOS manufactured by Sympatec Co.) equipped with a wet type homogenizer.

This apparatus measures a grain size distribution and at the same time, can measure a surface area in consideration of the grain size distribution upon assuming sample grains as true spheres. The specific gravity of a carrier, which is a necessary input value at the time, is a value measured by a High Accuracy Automatic Volume Meter (VM-100, manufactured by Estec Co.), employing a gas phase replacing method.

(Measurement Method of C Value)

The carbon content (weight percent) in a carrier coating resin was measured employing a Carbon Analyzer EMIA-521 Type (manufactured by Horiba Seisakusho). The carbon contents of magnetic particles alone and of a resin-coated carrier were obtained based on a calibration curve employing standard samples 168-3 (carbon content: 0.042 weight percent), 158-8 (carbon content: 0.12 weight percent), and 150-12 (carbon content: 0.49) of Nippon Tekkou Kyokai Co., and the carbon content corresponding to the carrier coating resin was calculated. Preferably, C is from 0.02 to 0.5.

The present invention is further explained.

(Carrier Composition)

As the carrier core which becomes the core of a silicone resin-coated carrier, various magnetic carrier cores known in the art can be employed. For example, ferrite, magnetite, and metals exhibiting ferromagnetism such as iron, cobalt, nickel, etc., and alloys or compounds containing these metals can be used.

Further, the ferrite as described herein denotes magnetic oxides comprising iron and univalent or divalent metals. Divalent metals include manganese, iron, nickel, cobalt, copper, zinc, magnesium, etc. and univalent metals include lithium, etc.

Specifically, the ferrite represented by $(MO)_a(M'O)_b(Fe_2O_3)_c$ (wherein M and M' each represents a metal element, and a, b, and c each is molar ratio) is preferred and preferred combinations of M—M' are Cu—Zn, Ni—Zn, Mn—Mg, and Cu—Mg. Furthermore, $(Li_2O)_d(Fe_2O_3)_e$ (d and e each represents molar ratio) is preferably employed and those may be employed in which the part is replaced with the oxide of alkali earth metals.

A carrier size, when triboelectrical charge generated in contact with a toner and adhesion of a carrier to a photoreceptor are considered, is preferably between 10 and 200 $\mu$m in terms of weight average particle diameter.

The silicone resins which can be preferably employed in the present invention are aggregations of the segment represented by general formulas (I) and (II) mentioned below.

(I)

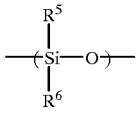

(II)

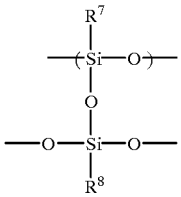

Of segments represented by (I) and (II), $R^5$ through $R^8$ each represents a hydrocarbon group selected from a methyl group, an ethyl group, a phenyl group, and a vinyl group. In view of adhesive properties and strength, those having the methyl group are particularly preferred. Furthermore, modified types such as alkyd modified, acrylic modified, polyester modified, phenol modified, melamine modified, urethane modified, etc. may be employed.

The ratio (I)/(II) of segment (I) to segment (II) is preferably from 0/100 to 70/30 and more preferably from 0/100 to 50/50.

Sufficient durability may be obtained in the case of (I)/(II)≦70/30, as suitable hardness due to the presence of an adequate straight chain component is obtained.

An aminosilane coupling agent may be employed in the carrier and the preferred examples are shown below.

Examples include γ-aminopropyltrimethoxysilane, γ-aminopropyltriethoxysilane, γ-aminoethylaminopropyltrimethoxysilane, methyl-γ-aminopropyldimethoxysilane, methyl-γ-aminoethylaminopropyldimethoxysilane, γ-dimethylaminopropyltrimethoxysilane, γ-anilinopropyltrimethoxysilane, γ-morpholinopropyltrimethoxysilane, N,N'-bis(3-trimethoxysilyl)ethylenediamine and partial condensation products thereof. Furthermore, two or more of aminosilane coupling agents may be employed upon mixing.

In order to minimize the variation of a charge amount due to environment and to maintain charge application to a toner, the added amount of the aminosilane coupling agent is between 0.01 and 8 weight parts per 100 weight parts of the solid portion of a silicone resin and preferably between 0.1 and 5 weight parts.

Other resins may be added to a silicone resin. For example, as a cross linking agent, low molecular silane compounds generally known as a dealcohol type, deacetic acid type, deoxime type, a deamide type, a deaminoxy type, a deacetone type, etc. can be employed.

As hardening catalysts, metal soap comprised of metals such as Zn, Sn, Fe, Pb, Co, Ni, Al, Zr, etc., chelate compounds, organic acids such as formic acid, acetic acid, etc., and bases such as amine, etc. can be employed.

The added amount of these additives is preferably between 0.01 and 10 weight parts per the solid portion of a silicone resin and more preferably between 0.1 and 5 weight parts.

Solvents employed for coating include toluene, xylene, methyl ethyl ketone, methyl isobutyl ketone, etc.

In order to form a uniform coating layer on the surface of a core and to minimize the granulation of carrier particles to maintain preferred fluidity and obtain mixable properties with a toner, the coating amount of a silicone resin in the resin-coated carrier is preferably between 0.01 and 10 weight percent and more preferably between 0.5 and 5 weight percent.

In order that the cross linking reaction of a silicone resin proceeds; sufficient harness is readily obtained, and furthermore, a uniform resin coated layer is readily obtained without causing the decomposition of the part of a silicone resin and a silane coupling agent, a method to form a coating layer onto a carrier core is in such a manner that after dissolving a silicone resin in a solvent, the resulting solution is coated onto the surface of a core employing a dipping method, a spray dry method, etc.; and the solvent is removed through drying. Thereafter, curing is carried out. The curing temperature is between 150 and 300° C. and preferably between 170 and 280° C.

(Toner Composition)

The toner employed in the present invention is composed of at least a binder resin and a colorant. The colorants include carbon black, lamp black, black pigments such as magnetic substances, etc. and color pigments and dyes such as cyan, magenta, yellow, etc.

In the present invention, the added amount of the colorants to a toner is preferably between 6 and 15 parts per 100 parts of a binder resin and more preferably between 8 and 12 weight parts.

Preferred examples of binder resins employed in a toner include styrene series resins, acrylic series resins, styrene-acrylic series resins, and polyester series resins.

A toner may be comprised of a releasing agent, if desired. The specific examples include olefin series such as low molecular weight polypropylene, low molecular weight polyethylene, ethylene-propylene copolymers, etc., microcrystan wax, carnauba wax, sasol wax, paraffin wax, etc. The added amount of the releasing agent is preferably between 1 and 10 weight parts per 100 weight parts of a binder resin, and more preferably between 1 and 5 weight parts.

A toner is typically prepared in such a manner that raw materials are previously mixed in the dry state; thereafter, the resulting mixture is melt-kneaded, pulverized, and classified. As methods to mix the raw materials in the dry state, are listed a Henschel mixer, a V type mixer, a redige mixer, a nauter mixer, W cone mixer, a vibro mill, a tabular, etc.

Fine inorganic particles may be incorporated into a toner from view of rendering fluidity. Preferred fine inorganic particles include fine inorganic oxide particles such as silica, titania, alumina, etc. Furthermore, these fine inorganic particles may be subjected to hydrophobic treatment employing a silane coupling agent or a titanium coupling agent. Of these, the addition of hydrophobic silica is particularly preferred and the number average diameter of the primary particles of the hydrophobic fine silica particles is preferably between 5 and 300 nm. Furthermore, the addition ratio of the hydrophobic fine silica particles is preferably between 0.1 and 2 weight parts with respect to the toner.

In the present invention, a positively chargeable charge control agent is preferably incorporated into a toner. As the charge control agents, those represented by general formula (III) described below are preferably employed.

(III)

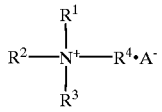

wherein $R^1$ to $R^4$ each represents a substituted or unsubstituted alkyl group having from 1 to 18 carbon atoms or an unsubstituted benzyl group, and $A^-$ represents an anion. However, at least one of $R^1$ to $R^4$ represents an alkyl group having from 8 to 18 carbon atoms. A represents substituted benzene or substituted naphthalene, a halogen ion such as $Cl^-$, $Br^-$, a metal oxide ion such as molybdenum oxide ion, etc.

As specific compounds, those shown below are listed.

1.

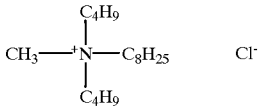

2.

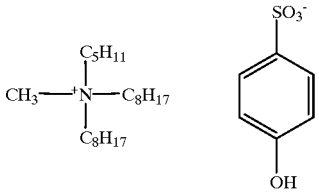

3.

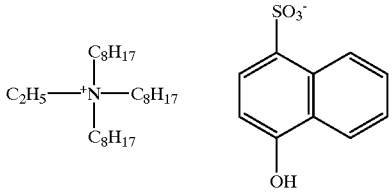

4.

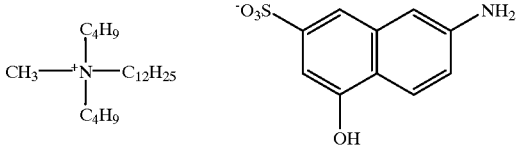

5.

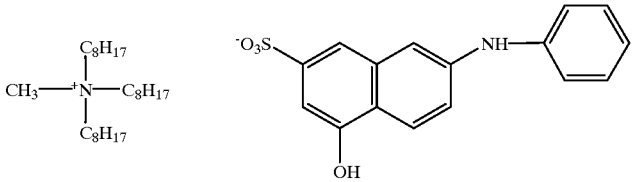

-continued

6.

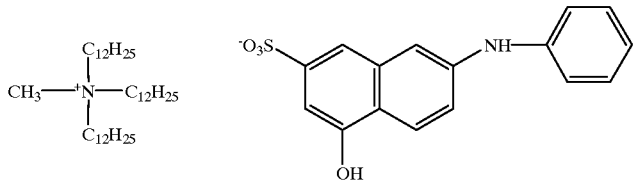

7.

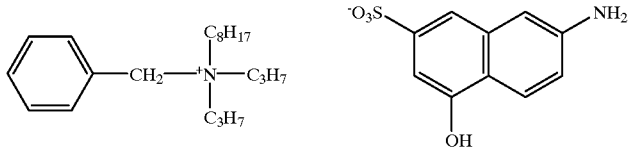

8.

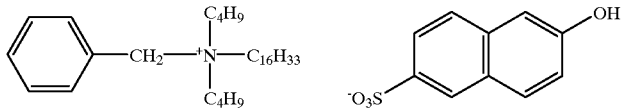

9.

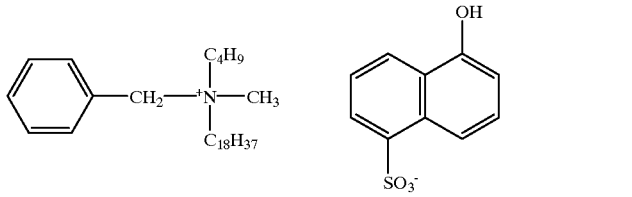

10.

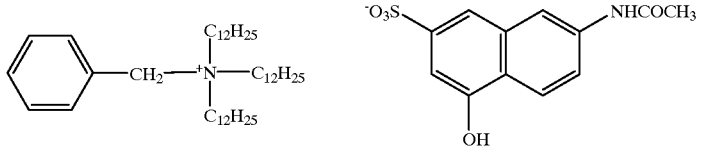

11.

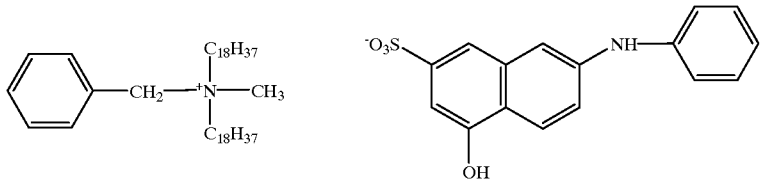

An image forming method is explained below.

FIG. 1 shows an image forming apparatus which can be employed for the embodiment of an image forming method. Around an image bearing body (photoreceptor) provided with a photoconductive photosensitive layer, there are provided with a charge electrode 11, a development mechanism 12, a transfer separation electrode 13, a cleaning mechanism 14, and a discharging lamp 15. A recording material (transfer material) from a paper supply mechanism 16 receives the transfer of a toner image employing the transfer separation electrode 13; thereafter, is conveyed by a conveyance mechanism 17; and is fixed by a fixing mechanism 18; and an image is formed. After transfer, the residual toner on the image bearing body (photoreceptor) 10 is scrape-removed. The recovered toner is preferably returned to the development mechanism 12 employing a recycle mechanism such as 19 and reused. Each process is explained below.

(Development Process)

A developer material is conveyed to a development zone employing a developer material conveyance member and the electrostatic latent image on an image bearing body is developed by the developer material to form a prefixed toner image.

Specific examples of development methods are shown.

(1) Contact Magnetic Brush Development Method

Figure 2:
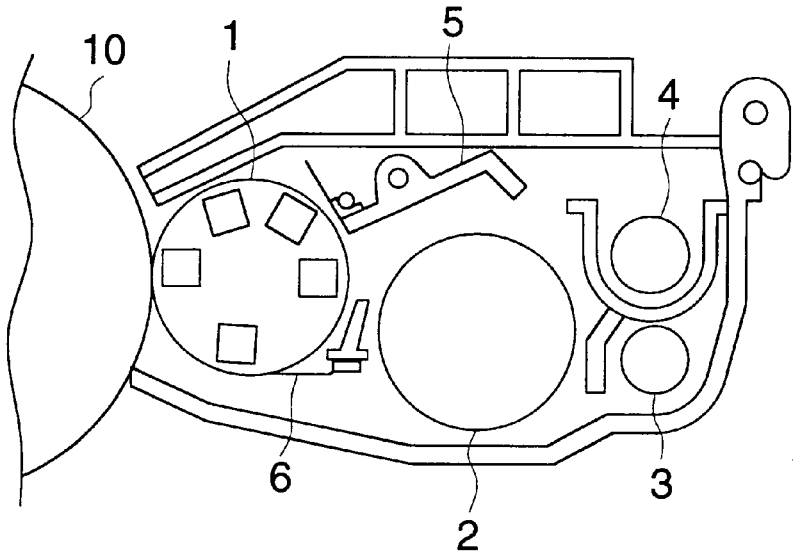
FIG. 2 a schematic sectional view explaining a development method according to the present invention.

In this method, as shown in FIG. 2, on a developer material conveyance body 1, a developer material magnetic brush having a taller bristle than the gap in the development zone is formed and this magnetic brush is conveyed to a development zone, and while sliding an electrostatic latent image on the image bearing body 10, the toner in the magnetic brush is adhered to the electrostatic latent image to carry out development. Further, the numeral 2 is a main stirring roller, 3 is a supplementary stirring roller, 4 is a toner conveyance screw, 5 is a bristle length regulation plate and 6 is a doctor blade.

(2) Noncontact Magnetic Brush Development Method

In this method, on a developer material conveyance body, a developer material magnetic brush having a shorter bristle than the gap in a development zone is formed; this magnetic brush is conveyed to the development zone; at the same time, by applying an oscillating electric field to the development zone, the toner in the magnetic brush is allowed to jump and is adhered to an electrostatic latent image to carry out development.

(Transfer Process)

The prefixed toner image on the image bearing body obtained by development is transferred to a recording material (transfer material). In this transfer process, either an electrostatic transfer system or a bias transfer system can be employed and particularly, the electrostatic transfer system is preferred. Specifically, for example, a transfer device which generates a direct current corona discharging is arranged so as to face an image bearing body via a recording material, and by applying the direct current corona discharging to the recording material from the back side, the prefixed toner image borne on the surface of the image bearing body is transferred to the surface of the recording material.

(Cleaning Process)

After completing the transfer process, the residual toner on the image bearing body is cleaned. A cleaning device is preferred which comprises a cleaning blade arranged so as to be in contact with the surface of the image bearing body. When this cleaning device is employed, the residual toner is scraped and removed by sliding the surface of the image bearing body with a cleaning blade.

Figure 3:
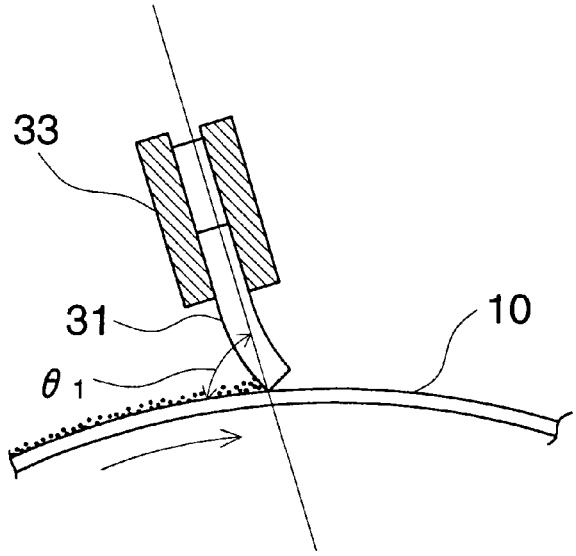
FIG. 3 is a view explaining the constitution of a cleaning blade.
Figure 4:
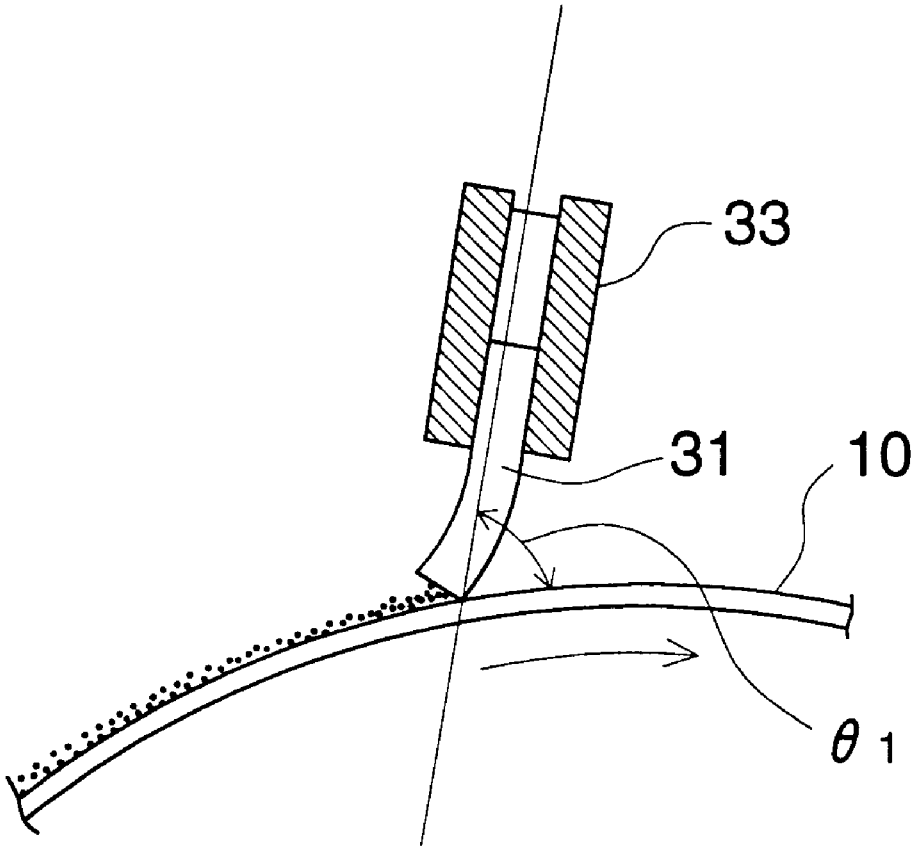
FIG. 4 is a view explaining the constitution of a cleaning blade.

The representative examples of the cleaning blades are go described in FIGS. 3 and 4. In FIGS. 3 and 4, a structure is such that a cleaning blade 31 is sustained by a holder 33.The numeral 10 is a image bearing body (photoreceptor). The angle $\theta_1$ formed by the holder in respect to the photoreceptor is preferably between 20° and 90° shown in FIGS. 3 and 4 and more preferably between 30° and 75°. Examples of materials of the blade itself are elastic materials such as silicone rubber, urethane rubber. In this case, the hardness of rubber is preferably between 30° and 90°. The thickness of 2 to 10 mm and the external holder part length of 5 to 40 mm are preferred. The contact pressure to the photoreceptor is suitably between 5 and 30 gf/mm.

The toner recovered by this cleaning process is preferably introduced into a recycle process and recycled.

(Fixing Process)

The recording material which is subjected to transfer of a prefixed toner image through a transfer process is fixed employing a thermal fixing mechanism to form a fixed toner image on the recording material.

EXAMPLES

The present invention is explained in detail with reference to examples. The following "parts" are by "weight parts".

<Preparation of Carrier 1>

A mixture of 23 mole percent of $Li_2$3 and 77 mole percent of $Fe_2O_3$ was pulverized and mixed employing a wet type ball mill for 3 hours; dried; thereafter, was provisionally sintered at 900° C. for 2 hours; and the resulting was pulverized for 3 hours employing a ball mill and slurried. The resulting slurry was added with a dispersing agent and a binder, granulated and dried; thereafter, was subjected to main sintering at 1200° C. for 3 hours to prepare Ferrite Core Particle 1 with a volume average particle diameter of 60 $\mu$m.

Next, after adding, to a toluene solvent, 100 parts of Silicone Resin 1 (solid portion 50%) composed of the resin of the segment ratio of (I)/(II)=2/98 in which $R^5$ to $R^8$ each represents a methyl group and 0.2 part of γ-aminopropyltrimethoxysilane, the resulting composition was coated in an amount of 0.5 weight percent in respect to Ferrite Core Particle 1 employing a fluid bed and furthermore, cured at 170° C. for 2 hours. Employing a V type mixer, 600 g of the resulting carrier was processed for 60 minutes at 30 rpm to prepare Carrier 1.

<Preparation of Carrier 2>

After adding, to a toluene solvent, 100 parts of silicone resin 1 (solid portion 50%) composed of the resin of the segment ratio of (I)/(II)=10/90 in which R' to R' each represents a methyl group, the resulting composition was coated in an amount of 0.5 weight percent in respect to ferrite core particle 1 employing a fluid bed and furthermore, cured at 200° C. for 3 hours.

Employing a V type mixer, 600 g of the resulting carrier was processed for 90 minutes at 30 rpm to prepare Carrier 2.

<Preparation of Carriers 3, 4, and 5>

A mixture of 15 mole percent of CuO, 30 mole percent of ZnO, and 55 mole percent of $Fe_2O_3$ was processed in the same manner as in preparation of Carrier 1 to prepare ferrite core particle 3 with a volume average particle diameter of 75 $\mu$m.

Next, after adding, to a toluene solvent, 100 parts of silicone resin 1 (solid portion 50%) shown in the preparation of Carrier 1, 1.0 part of dibutylstannatediurate as a catalyst, the resulting composition was coated in an amount of 0.3 weight percent in respect to ferrite core particle 2 employing a fluid bed and cured under conditions shown in Table 1 and 500 g of each of particles was processed for 30 minutes at 90 rpm employing a tabular mixer to prepare Carriers 3, 4, and 5.

TABLE 1

| | Curing Conditions | | | | | |
|---|---|---|---|---|---|---|
| | Temperature (° C.) | Time (hour) | C Value (weight) | $S_{BET}$ ($m^2/g$) | Sc ($m^2/g$) | Surface Index S |
| Carrier 1 | 170 | 2 | 0.15 | 1.15 | 0.22 | 34.8 |
| Carrier 2 | 200 | 3 | 0.32 | 2.20 | 0.22 | 31.3 |
| Carrier 3 | 190 | 1 | 0.12 | 0.95 | 0.17 | 46.6 |
| Carrier 4 Comparative | 150 | 2 | 0.12 | 0.20 | 0.17 | 9.8 |
| Carrier 5 Comparative | 200 | 4 | 0.12 | 1.75 | 0.17 | 85.8 |

<Preparation of Toner>

A mixture of 100 parts of a styrene-acrylic resin, 12 parts of carbon black, 3 parts of low molecular weight polypropylene, and 1 part of a charge control agent (Exemplified Compound 1) was melt kneaded, pulverized, and classified, and thereafter, colored particles with a volume average particle diameter of 8.5 $\mu$m were prepared. Subsequently, 1.0 weight percent of hydrophobic silica was added and the resulting mixture was mixed employing a high speed stirrer to prepare a toner.

<Preparation of Developer Material>

The above-mentioned toners and carriers are combined as shown in Table 2 and regulated so that the toner content becomes 4.0 weight percent, and Examples 1, 2, and 3, and Comparative Examples 4 and 5 were prepared.

TABLE 2

| | Toner | | Carrier | | Charge |
|---|---|---|---|---|---|
| | No. | Added Amount (g) | No. | Added Amount (g) | Amount of Developer ($\mu$C/g) |
| Developer Material 1 | Toner | 30 | Carrier 1 | 720 | 28.9 |
| Developer Material 2 | Toner | 30 | Carrier 2 | 720 | 25.1 |
| Developer Material 3 | Toner | 30 | Carrier 3 | 720 | 20.6 |

TABLE 2-continued

| | Toner | | Carrier | | Charge |
|---|---|---|---|---|---|
| | No. | Added Amount (g) | No. | Added Amount (g) | Amount of Developer ($\mu$C/g) |
| Developer Material 4 | Toner | 30 | Carrier 2 | 720 | 11.3 |
| Developer Material 5 | Toner | 30 | Carrier 3 | 720 | 33.7 |

<Evaluation Items>

Image Density

The relative density of the black solid part of a copied image, corresponding to the white background part (reflection density of 0.00) of a transfer sheet paper (transfer material) was measured employing a Macbeth densitometer.

Not less than 1.25 is evaluated to be A, not less than 1,10 to not more than 1.25 is evaluated to be B, and not more than 1.10 is evaluated to be C.

Background Density

The relative density of the white background part of a copied image corresponding to the white background part (reflection density of 0.00) of a transfer sheet was measured employing a Sakura Densitometer (manufactured by Konica Corp.)

Not more than 0.005 exhibiting no problem is evaluated to be A, not less than 0.005 to not more than 0.01 is evaluated to be B, and not less than 0.01 exhibiting a problem for commercial use is evaluated to be C.

Toner Scattering

A sheet of white paper was placed at the lower part of a development zone; a scattered toner was brought into adhesion on it; the sheet was fixed under the same fixing conditions as an evaluating machine; and the resulting density was measured as a relative density corresponding to the white background part (reflection density of 0.00) of a sheet of the paper, employing a Sakura Densitometer.

Relative density of not more than 0.1 is evaluated to be -A, not less than 0.2 to not more than 0.2 is evaluated to be B, and not less than 0.2 is evaluated to be C.

<Image Forming Evaluation>

In the above-mentioned evaluation, a modified Electronic Copier (U-BIX 4355 manufactured by Konica Corp.) provided with a toner recycle system, which is mounted with a negatively chargeable organic photoreceptor, and a permeability type toner concentration sensor was employed, and an image forming evaluation during 100,000 copy running was carried out (environmental conditions: temperature 25° C. and 55% relative humidity).

Table 3 shows the evaluation results.

TABLE 3

| | Developer Material | Image Density (number of copies) | | | Background Density | | | Toner Scat- |
|---|---|---|---|---|---|---|---|---|
| | No. | 1 | 10,000 | 100,000 | 1 | 10,000 | 100,000 | tering |
| Example 1 | 1 | A | A | A | A | A | A | A |
| Example 2 | 2 | A | A | A | A | A | A | A |
| Example 3 | 3 | A | A | A | A | A | B | B |
| Comparative Example 1 | 4 | A | A | A | C | C | C | C |
| Comparative Example 2 | 5 | C | C | A | A | A | C | C |

In Examples 1, 2, and 3, no variation of the charge amount during the initial period of running is caused; the image density is high and stable up to 100,000 copies; neither Background Density nor toner scattering is caused; quality images are formed; and sufficient durability was confirmed.

On the other hand, in Comparative Example 1, a sufficient charge amount was not obtained from the time of preparing a developer material and Background Density on images was caused.

Furthermore, in Comparative Example 2, the initial charge amount was too high to obtain sufficient image density; later along with an increase of the number of copies, the coated layer on the carrier peeled off, and as a result, the charge amount was decreased, and Background Density and toner scattering were caused.

What is claimed is:

1. A carrier which is coated with a silicone resin and exhibits a Surface Index S of 10.0 to 70.0 wherein $$S=(S_{BET}/X)/Sc$$

$S_{BET}$: BET specific surface area ($m^2/g$)

X: C value (carbon content of said silicone resin in weight percent based on the total resin coated carrier), Sc: surface area ($m^2/g$) when assumed to be a true sphere.

2. The carrier of claim 1, wherein the surface index S is 15.0 to 60.0.

3. The carrier of claim 1, wherein size of the carrier is 10 to 200 $\mu$m in term of weight average particle size diameter.

4. The carrier of claim 1, wherein said silicone resin has segment I or segment II, represented by formulas (I)

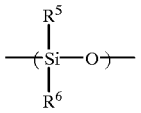

(II)

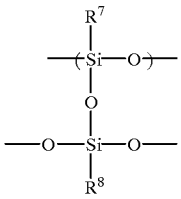

wherein $R^5$ through $R^8$ each represents a hydrocarbon group.

5. The carrier of claim 1 comprising said silicone resin in amount of 0.01 to 10 weight percent.

6. The carrier of claim 1 produced by curing said silicone resin at temperature of 150 to 300° C.

7. The carrier of claim 1 wherein the C value is 0.02 to 0.5.

8. The carrier of claim 1, wherein the surface index S is 15.0 to 60.0, the size of the carrier is 10 to 200 $\mu$m in term of weight average particle size diameter, the carrier comprises silicone resin in amount of 0.01 to 10 weight percent, and the C value is 0.02 to 0.5.

9. The carrier of claim 1 wherein, prior to mixing a toner with said carrier, said carrier is subjected to mechanical impact.

10. The carrier of claim 1 comprising a core containing $(Li_2O)d(Fe_2O_3)e$ wherein d and e each represent molar ratio.

11. A developer material composed of at least the silicone resin-coated carrier of claim 1 and a toner.

12. A developer material of claim 11 wherein the toner comprises a binder resin, a colorant, and a positively chargeable charge control agent wherein, prior to mixing of said toner with said carrier, the carrier is subjected to mechanical impact.

13. An image forming method wherein an electrostatic latent image on a photoreceptor is developed to a toner image employing the developer material of claim 11; the resulting toner image is transferred to a supplied image transfer material.

* * * * *